US011737545B2

(12) United States Patent
Tarajano Noya et al.

(10) Patent No.: US 11,737,545 B2
(45) Date of Patent: Aug. 29, 2023

(54) COSMETIC PRODUCT SAMPLING SYSTEM

(71) Applicant: ELC MANAGEMENT LLC, Melville, NY (US)

(72) Inventors: Lemis Tarajano Noya, Miami, FL (US); Robyn Lynne Adams, Long Island City, NY (US); Marc Emile Lechanoine, New York, NY (US); Gianluca Mattaroccia, Sunnyside, NY (US); Timothy Hugh Calvert, Brentwood, TN (US); Douglas John Melenkevitz, Boonton, NJ (US)

(73) Assignee: ELC MANAGEMENT LLC, Melville, NY (US)

( * ) Notice: Subject to any disclaimer, the term of this patent is extended or adjusted under 35 U.S.C. 154(b) by 190 days.

(21) Appl. No.: 17/345,280

(22) Filed: Jun. 11, 2021

(65) Prior Publication Data

US 2022/0395071 A1 Dec. 15, 2022

(51) Int. Cl.

| | |
|---|---|
| ***A45D 33/28*** | (2006.01) |
| ***A45D 40/22*** | (2006.01) |
| ***A45D 40/24*** | (2006.01) |

(52) U.S. Cl.

CPC ..... *A45D 33/28* (2013.01); *A45D 40/22* (2013.01); *A45D 40/24* (2013.01);
(Continued)

(58) Field of Classification Search

CPC ..... A45D 40/24; A45D 40/22; A45D 40/00; A45D 33/28; A45D 40/14; A45D 2200/052; A45D 2200/1036; A45D 2200/25; A45D 2040/0031; A45D 2040/204; A45D 2040/0043; A45D 2040/005

See application file for complete search history.

(56) References Cited

U.S. PATENT DOCUMENTS 2,588,611 A * 3/1952 Breen ..... A45D 33/28 132/297
6,997,321 B2 2/2006 Young
(Continued)

FOREIGN PATENT DOCUMENTS

| | | | |
|---|---|---|---|
| CN | 110891454 | A | 3/2020 |
| KR | 20200030928 | A | 3/2020 |
| WO | WO-2009/054918 | A1 | 4/2009 |

OTHER PUBLICATIONS

International Application No. PCT/US2022/032919, International Search Report and Written Opinion, dated Oct. 7, 2022.
(Continued)

*Primary Examiner* — Nicholas D Lucchesi
(74) *Attorney, Agent, or Firm* — MARSHALL, GERSTEIN & BORUN LLP

(57) ABSTRACT

A system for sample, trial, and/or full-sized products includes a container defining at least one cavity, a product disk, a cosmetic product, and an applicator. The product disk includes a first side, a second side, and a body extending therebetween. The product disk is positionable adjacent to the at least one cavity of the container. The cosmetic product is at least partially disposed on the first side of the product disk. The applicator has first end that includes an applicator coupling mechanism. The product disk is removably coupled with the cavity of the container and the applicator coupling mechanism.

5 Claims, 9 Drawing Sheets

(52) U.S. Cl.
CPC ..... *A45D 2200/052* (2013.01); *A45D 2200/1036* (2013.01); *A45D 2200/25* (2013.01)

(56) References Cited

U.S. PATENT DOCUMENTS

| | | | | |
|---|---|---|---|---|
| 8,226,311 | B2 | 7/2012 | Cronin | |
| 9,220,332 | B1 * | 12/2015 | DeVito | A45D 33/22 |
| 9,277,798 | B2 * | 3/2016 | Moreau | B05B 11/1032 |
| 9,974,377 | B2 | 5/2018 | Keller et al. | |
| 2006/0123955 | A1 * | 6/2006 | Cho | B25G 3/18 81/177.2 |
| 2006/0243295 | A1 | 11/2006 | Petit | |
| 2008/0087296 | A1 | 4/2008 | Gueret | |
| 2009/0241981 | A1 | 10/2009 | Dobler et al. | |
| 2009/0324318 | A1 | 12/2009 | Wilde et al. | |
| 2012/0266910 | A1 | 10/2012 | Tarling et al. | |
| 2013/0061867 | A1 | 3/2013 | Kim et al. | |
| 2013/0133678 | A1 * | 5/2013 | Nakashima | A45D 19/012 401/196 |
| 2015/0282593 | A1 | 10/2015 | Earl | |
| 2016/0174679 | A1 | 6/2016 | Gorostiza et al. | |
| 2016/0199162 | A1 * | 7/2016 | Brilliant | A61C 3/02 132/328 |
| 2017/0224088 | A1 * | 8/2017 | Parekh | A45D 40/00 |
| 2019/0029398 | A1 * | 1/2019 | Zhang | A45D 40/00 |
| 2019/0053606 | A1 | 2/2019 | Thorpe et al. | |
| 2019/0281952 | A1 * | 9/2019 | Meranus | A45D 34/042 |
| 2020/0128939 | A1 | 4/2020 | Kim et al. | |
| 2022/0031045 | A1 * | 2/2022 | Trochel | A45D 40/16 |
| 2022/0386758 | A1 * | 12/2022 | Kobashi | A45D 40/16 |

OTHER PUBLICATIONS

International Application No. PCT/US2022/032920, International Search Report and Written Opinion, dated Oct. 4, 2022.

International Application No. PCT/US2022/032921, International Search Report and Written Opinion, dated Oct. 7, 2022.

Winky Lux, "Mini Lipstick Kit," (2021). Retrieved from Internet on Jun. 11, 2021: URL: https://www.winkylux.com/products/mini-lip-pill-kit.

Taiwan Patent Application No. 111121730, Office Action, dated Mar. 14, 2023.

Taiwan Patent Application No. 111121731, Office Action, dated Mar. 15, 2023.

Taiwan Patent Application No. 111121728, Office Action, dated Mar. 13, 2023.

* cited by examiner

COSMETIC PRODUCT SAMPLING SYSTEM

FIELD OF THE DISCLOSURE

The present disclosure generally relates to cosmetic, hair care, body care, and/or skincare products and, more particularly, to systems and approaches for sample, trial, and/or full-sized products.

BACKGROUND

Cosmetic and/or skincare products and applicators may have a number of different visual characteristics. For example, products such as lipstick may be provided in varying colors or shades, sheen levels (e.g., matte, satin, or sheer), and/or may have varying degrees of transfer resistance. Oftentimes, consumers may wish to test a number of different products prior to purchasing full-sized versions of the product. Existing sampling systems oftentimes includes excessive amounts of disposable packaging that may be costly to manufacture and/or may present environmental concerns. Current sampling and trial experiences may not mimic a full-sized product, and as such, may not provide a consumer with a similar experience as when using the full-sized product. More specifically, current sampling and trial experiences are provided in small sizes that may be difficult to hold and may present other ergonomic challenges. In the event a consumer has a variety of different samples each having discrete packaging, the user would need to carry the individual packages on their person, which may be confusing and present a barrier to trial.

Accordingly, there is a need for improved accessories having improved functionalities.

SUMMARY

Embodiments within the scope of the present disclosure are directed to a system for sample, trial, and/or full-sized products. Such a system may include a container defining at least one cavity, a product disk, a cosmetic product, and an applicator. The product disk includes a first side, a second side, and a body extending therebetween. The product disk is positionable adjacent to the at least one cavity of the container. The cosmetic product is at least partially disposed on the first side of the product disk. The applicator has first end that includes an applicator coupling mechanism. The product disk is removably coupled with the cavity of the container and the applicator coupling mechanism.

In an embodiment, the body of the product disk may include a ledge, and the applicator coupling mechanism may include a track that slidably engages the ledge of the body. In some examples, the first side of the product disk is adapted to be disposed within the cavity of the container when coupled therewith.

In some forms, the at least one cavity may include a stop mechanism that restricts planar movement of the product disk. In some approaches, the container may further define an applicator cavity adapted to retain at least a portion of the applicator.

In a variation of these embodiments, the at least one cavity of the container includes a retention member that retains the product disk therein. In some of these examples, the retention member may be in the form of at least one of a magnetic member, a sidewall, or a protrusion.

In some examples, the product may be in the form of at least one of a lipstick, a foundation, a concealer, an eyeshadow, a bronzer, a brow, a solid serum, a solid SPF product, a skin care item, a solid face balm, a lip balm, an applicator heads, a brush, a solid blush, a solid contouring stick, an impregnated sponge or carrier, or a semi-solid skin care or cosmetic product.

In some examples, the container may define a second cavity. The system may further include a second cosmetic product being at least partially disposed on a second product disk. The second cosmetic product may have a different visual characteristic than a visual characteristic of the cosmetic product.

In accordance with another aspect, a reusable product system includes an applicator, a product disk, and a cosmetic product. The applicator includes a first end that includes an applicator coupling mechanism. The product disk has a first side, a second side, and a body extending therebetween defining a ledge. The second side of the product disk is positionable adjacent to the first end of the applicator. The cosmetic product is at least partially disposed on the first side of the product disk. The product disk removably couples with the applicator via sliding engagement between the ledge and the applicator coupling mechanism.

BRIEF DESCRIPTION OF THE DRAWINGS

The above needs are at least partially met through provision of one, more than one, or any combination of the approaches for cosmetic and/or skincare sampling systems described in the following detailed description, particularly when studied in conjunction with the drawings, wherein.

Figure 1:
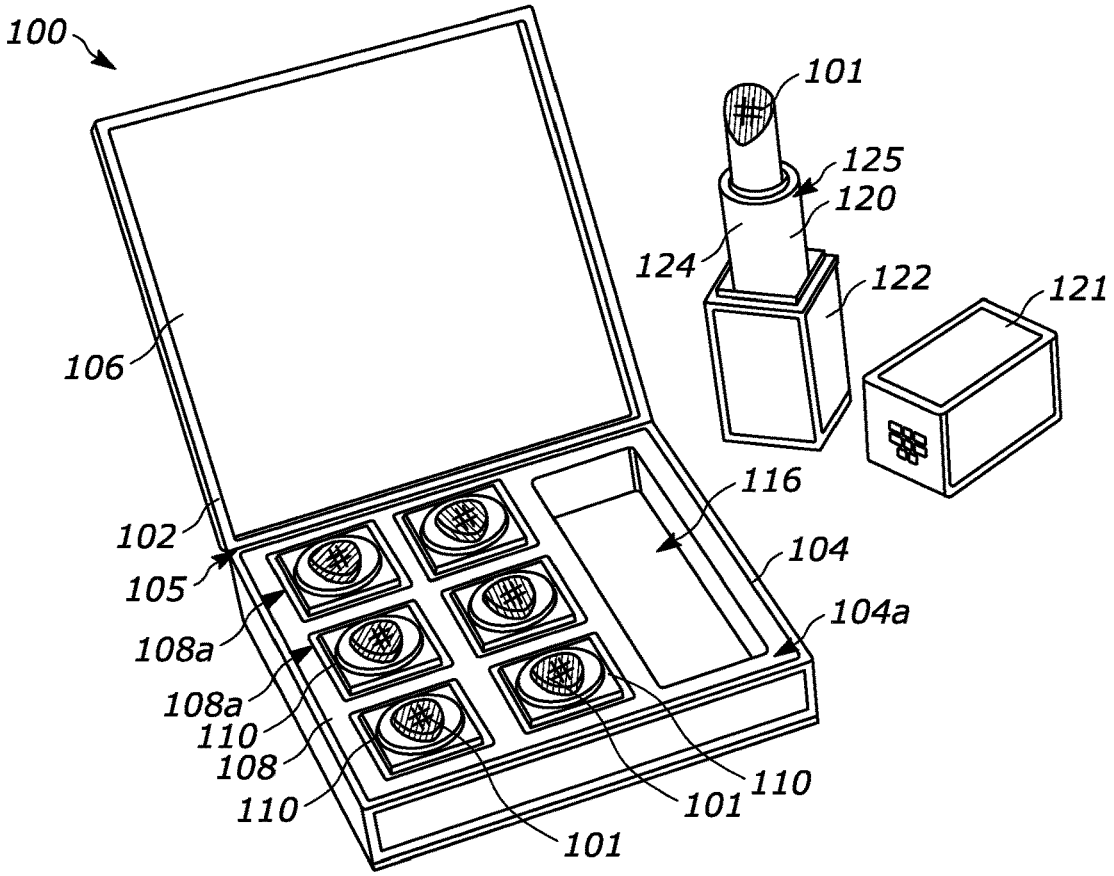
FIG. 1 illustrates a perspective view of an example sampling and/or trial system in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, a sampling and/or trial system for a product is provided having modular features. The sampling systems described herein allow for users to quickly and seamlessly replace or interchange different cosmetic and/or skincare products and applicators as desired to apply to their face and/or skin. The system may use reusable components and may reduce overall product packaging requirements. In some examples, upon a user determining which of the sample products they wish to purchase in larger (i.e., full-sized) quantities, the system may similarly accommodate such larger quantities therein.

Turning to the figures, a cosmetic and/or skincare sampling system 100 includes a cosmetic and/or skincare product 101, a container 102, an applicator 120, and any number of product disks 140. While the illustrated examples depict a lipstick product, in other examples, the product 101 may be any number or combination of different cosmetic and/or skincare products. For example, the product 101 may be in the form of a foundation, a concealer, an eyeshadow, a bronzer, a brow, a solid serum, a solid SPF product, a skincare item, a solid face balm, a lip balm, an applicator head such as a sponge, a brush, a solid blush, a solid contouring stick, an impregnated sponge or carrier capable of retaining a liquid skincare or cosmetic product, or a semi-solid skincare or cosmetic product.

The container 102 includes a base 104 having an interior cavity 104*a*, a lid 106, and a hinge 105 that rotatably couples the lid 106 with the base 104. In other examples (not illustrated) the lid 106 may be operably coupled with the base 104 via any number of suitable approaches such as, for example, a friction fit connection, a threaded connection, a magnetic connection, a vacuum or suction mechanism, and the like. Other examples are possible. The container 102 may be constructed from any number of suitable materials and/or combinations of materials such as, for example, metals, polymers, and the like. As illustrated in FIG. 1, the container 102 has a generally rectangular prismatic shape, though other suitable examples such as cylindrical are possible.

Figure 2:
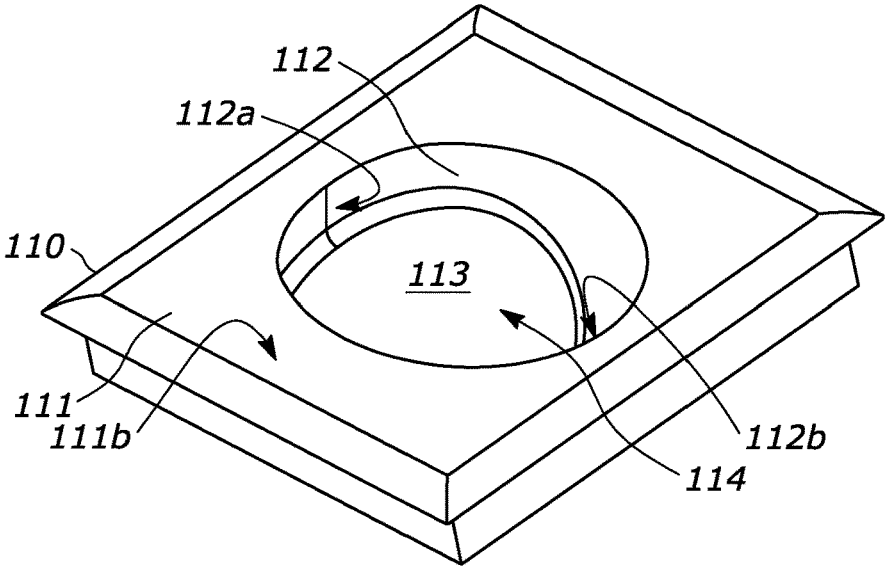
FIG. 2 illustrates a perspective view of an example tray adapted to retain a product for use with the example sampling system of FIG. 1 in accordance with various embodiments.
Figure 3:
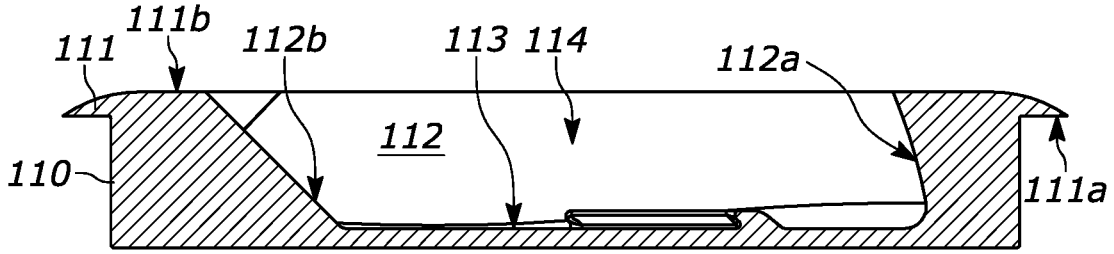
FIG. 3 illustrates a right side elevation cross-sectional view of the example tray of FIG. 2 in accordance with various embodiments.

The container 102 further includes a divider or top plate 108 having a number of openings 108*a* (e.g., six) dimensioned to receive a corresponding number of trays 110. The divider 108 may also include an applicator opening 108*b* dimensioned to receive the applicator 120. With reference to FIGS. 2 & 3, each tray 110 includes a support ledge 111 having a lower surface 111*a* and an upper surface 111*b*, a sidewall 112 extending downwardly from the support ledge 111, and a lower surface 113. The lower surface 111*a* of the support ledge 111 is adapted to rest on (i.e., is positionable adjacent to) the divider 108 such that the remainder sidewall 112 and the lower surface 113 are at least partially disposed within is in the opening 108*a* (and thus into the interior cavity 104*a* of the base 104). In some examples, the lower surface 111*a* of the support ledge 111 (and thus the tray 110) and the divider 108 may be coupled with each other using magnets, adhesives, a friction-fit coupling, and the like. Other examples are possible.

Figure 4:
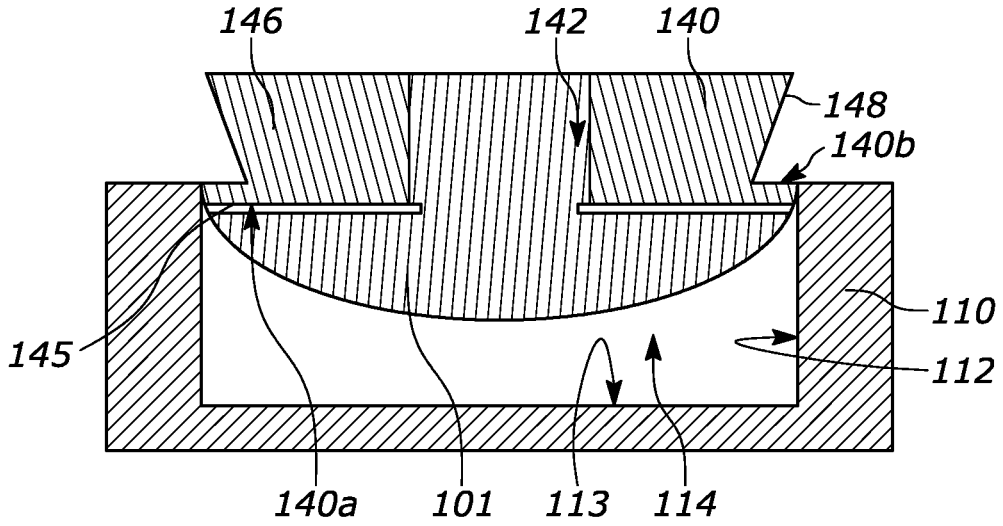
FIG. 4 illustrates a cross-sectional schematic view of an example product disk being positioned adjacent to the example tray of FIGS. 2 and 3 in accordance with various embodiments.
Figure 5:
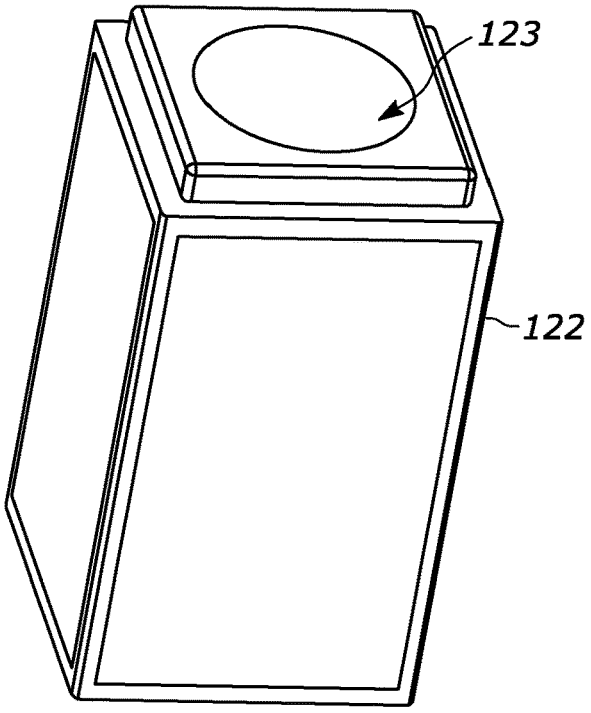
FIG. 5 illustrates a perspective view of an example applicator base for use with the example sampling system of FIGS. 1-4 in accordance with various embodiments.
Figure 6:
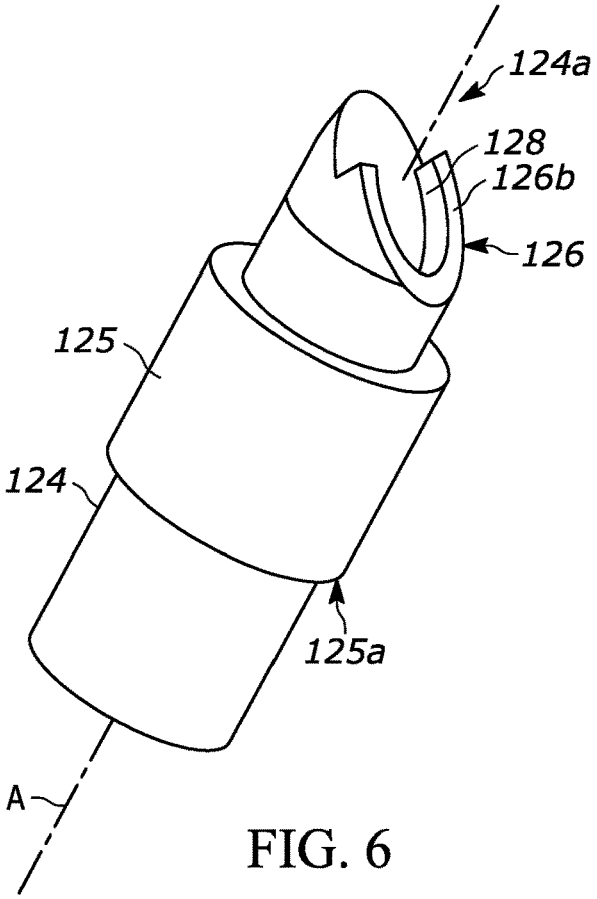
FIG. 6 illustrates a perspective view of an example applicator tube for use with the example sampling system of FIGS. 1-5 in accordance with various embodiments.

The sidewall 112 of the tray 110 includes a front portion 112*a* and a rear portion 112. As illustrated in FIG. 4, the sidewall 112 and the lower surface 113 combine to define a cavity 114 which is dimensioned to receive and/or retain at least a portion of the product disk 140 and/or a quantity of cosmetic product 101 disposed thereon. In some examples, the front portion 112*a* of the sidewall 112 may include a stop mechanism to prevent the product disk 140 from advancing in a lateral direction beyond the front portion 112*a*. More specifically, the front portion 112*a* of the sidewall 112 is angled acutely relative to the lower surface 113, therefore preventing the product disk 140 from sliding upwardly therefrom and out of the cavity 114. In other examples, such a stop mechanism may be in the form of a frictional engagement, a notch, a tab, a protrusion, and the like. Other examples are possible. In some examples, the rear portion 112*b* of the sidewall 112 may similarly include a retention member to prevent the product disk 140 from being removed outwardly therefrom. As illustrated in FIG. 3, the sidewall 112 has a curved, angled surface relative to the lower surface 113. However, in other examples, the sidewall 112 may be generally perpendicular to the lower surface 113.

With reference to FIGS. 5-11, the applicator 120 includes a cap 121, an applicator base 122, and an applicator tube 124. The applicator base 122 may be used as a handle a user grasps when applying the desired cosmetic product 101, and includes an opening 123 to receive a portion of the applicator tube 124. The applicator tube 124 includes a first end 124*a*, a second end 124*b*, a body 125 extending therebetween, and an applicator coupling mechanism 126. The applicator body 125 extends along a longitudinal axis "A". In the illustrated example, the applicator tube 124 is generally cylindrical in shape, though other configurations are possible. In the illustrated examples, the first end 124*a* of the applicator tube 124 is obliquely angled relative to the longitudinal axis A, though other relative configurations are possible. Accordingly, in this configuration, the first end 124*a* of the applicator tube 124 defines a generally planar, ovoid surface.

The second end 124*b* of the applicator tube 124 is insertable into the opening 123 of the applicator base 122, and may be secured therewith via a number of approaches such as, for example, a threaded connection, a friction-fit connection, the use of protrusions and corresponding notches, and the like. Other examples are possible. The body 125 of the applicator tube 124 includes a flange region 125*a* adapted to abut the applicator base 122 when the second end 124*b* of the applicator tube 124 is inserted into the opening 123.

Figure 7:
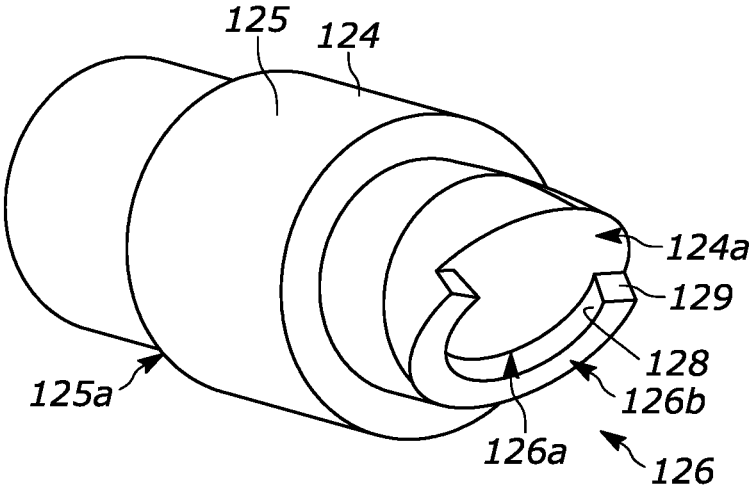
FIG. 7 illustrates a front perspective view of the example applicator tube of FIG. 6 in accordance with various embodiments.
Figure 8:
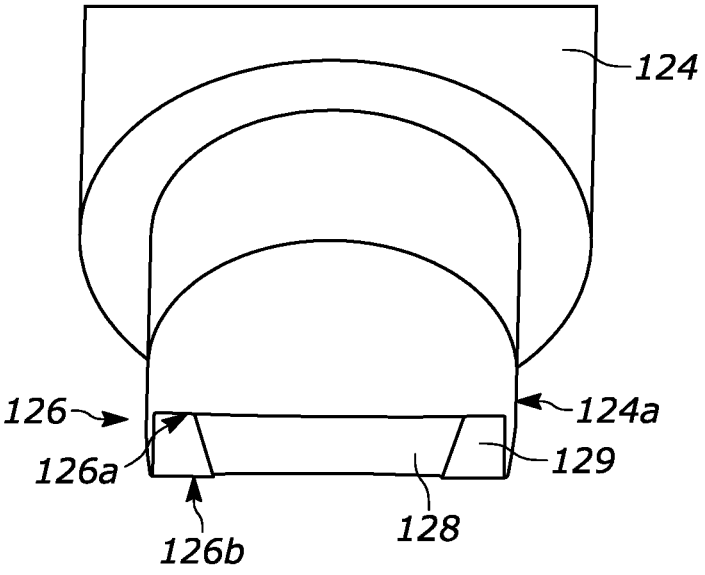
FIG. 8 illustrates an upper front perspective view of the example applicator tube of FIGS. 6 & 7 in accordance with various embodiments.
Figure 9:
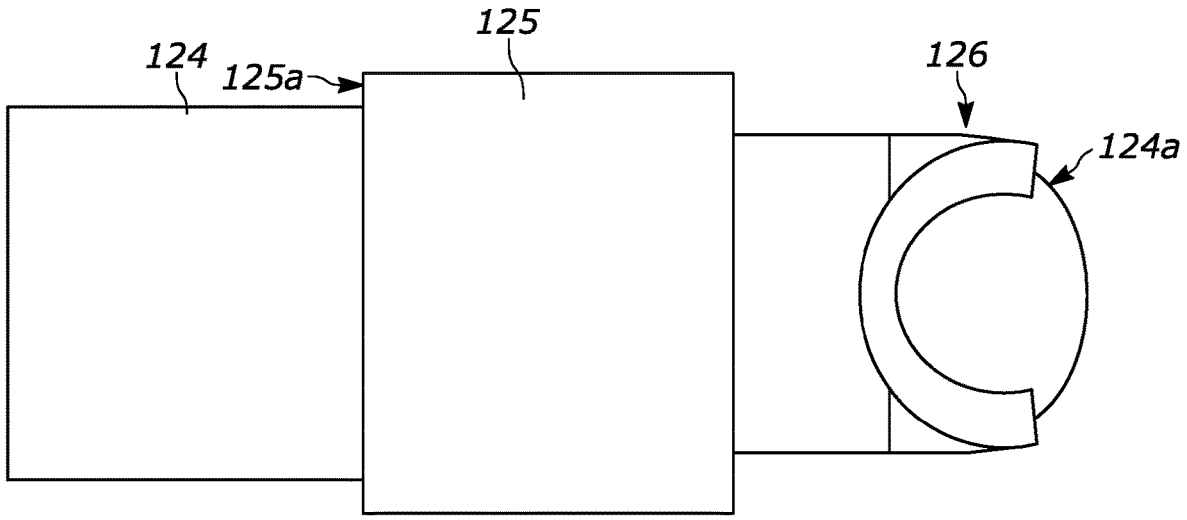
FIG. 9 illustrates a front elevation view of the example applicator tube of FIGS. 6-8 in accordance with various embodiments.
Figure 10:
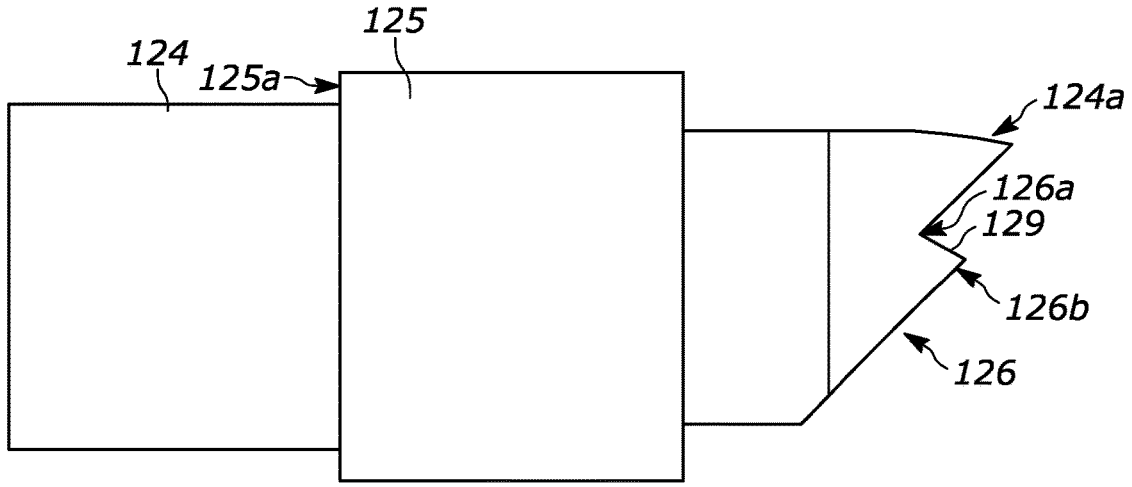
FIG. 10 illustrates a side elevation view of the example applicator tube of FIGS. 6-9 in accordance with various embodiments.
Figure 11:
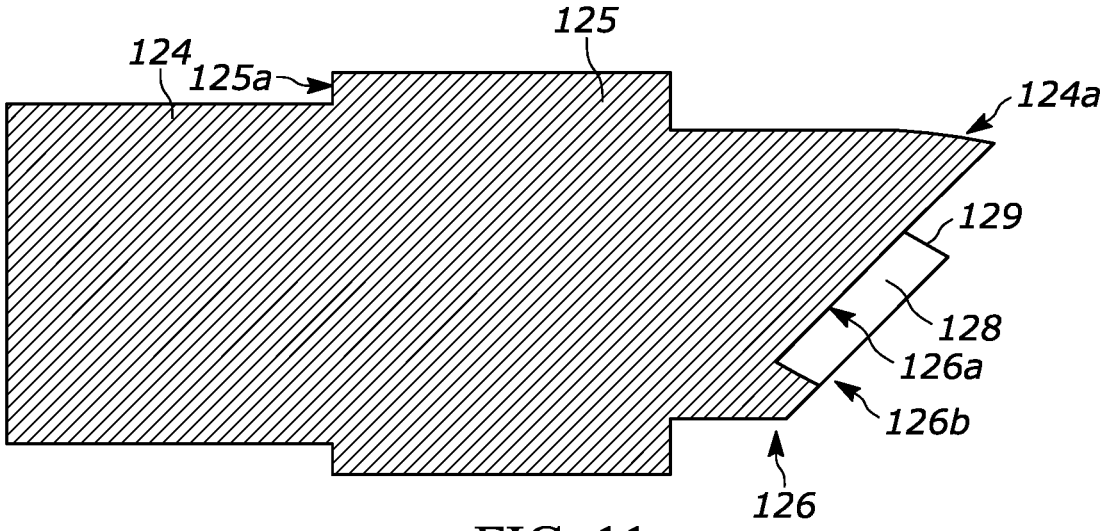
FIG. 11 illustrates a side elevation cross-sectional view of the example applicator tube of FIGS. 6-10 in accordance with various embodiments.
Figure 12:
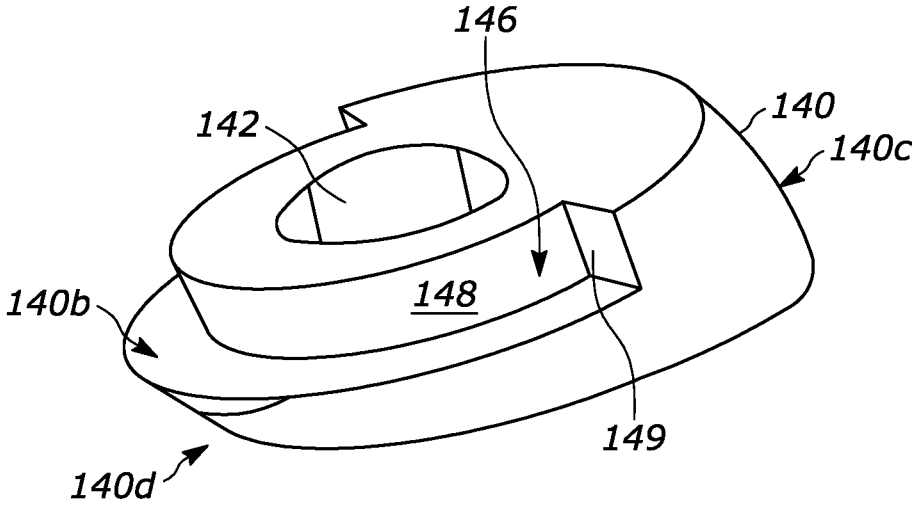
FIG. 12 illustrates a top side perspective view of an example product disk for use with the example sampling system of FIGS. 1-11 in accordance with various embodiments.
Figure 13:
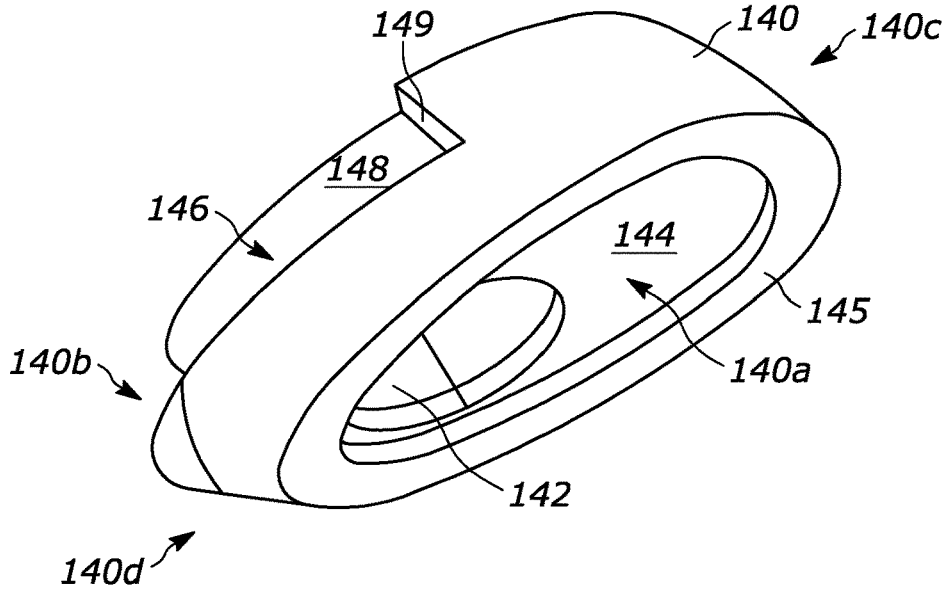
FIG. 13 illustrates a bottom side perspective view of the example product disk of FIG. 12 in accordance with various embodiments.
Figure 14:
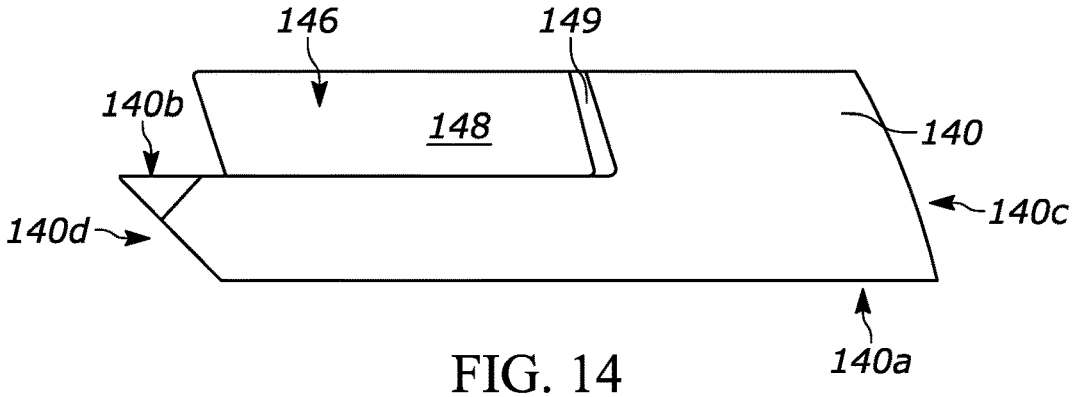
FIG. 14 illustrates a side elevation view of the example product disk of FIGS. 12 & 13 in accordance with various embodiments.

The applicator coupling mechanism 126 is positioned at the first end 124*a* of the applicator tube 124. The applicator coupling mechanism 126 is in the form of a raised track that extends outwardly from the first end 124*a* of the applicator tube 124 and around a peripheral edge thereof. More specifically, the applicator coupling mechanism 126 includes a first end 126*a* positioned adjacent to the generally planar surface of the first end 124*a* of the applicator tube 124 and a second end 126*b* positioned distally from the first end 124*a* of the applicator tube 124. An inner sidewall 128 is disposed between the first and second ends 126*a*, 126*b*. The second end 126*b* is defined by a generally planar surface that is parallel to the generally planar surface defined by the first end 124*a* of the applicator tube 124. The applicator coupling mechanism 126 further includes a stop surface 129. As seen in FIGS. 7 and 8, the applicator coupling mechanism 126 has a tapered cross-sectional shape whereby the second end 126*b* thereof has a larger width dimension than the first end 126*a*. Put differently, the track of the applicator coupling mechanism 126 is generally trapezoidal in cross-sectional shape. Other cross-sectional shapes are possible.

In some approaches, the applicator coupling mechanism 126 may be integrally formed with the applicator tube 124. However, in other examples, the applicator coupling mechanism 126 may be releasably secured with the applicator tube 124.

Turning to FIGS. 12-17, the product disk 140 is in the form of a body having a first or lower side 140*a*, a second or upper side 140*b*, a front portion 140*c*, and a rear portion 140*d*. A throughbore 142 extends through the disk 140. In the illustrated examples, each of the first and second sides 140*a*, 140*b* are generally planar and are generally parallel to each other. However, other arrangements are possible. The first side 140*a* of the product disk 140 includes a product receiving surface 144 and a raised outer edge 145 positioned around a periphery of the product receiving surface 144. With brief reference to FIGS. 4 and 18, the product receiving surface 144 is dimensioned to receive a sample quantity of product 101 thereon. For example, the product receiving surface 144 may accommodate a quantity of lipstick sufficient for between approximately two and approximately ten applications. Other examples of suitable quantities are possible. In the illustrated example, the product 101 protrudes outwardly from the product receiving surface 144 and forms an oval shape, though other arrangements are possible depending on the desired application style and/or profile.

The product disk 140 is dimensioned such that it may be positioned adjacent to and/or partially within the cavity 114 of the tray 110. More specifically, in some arrangements, the periphery of the raised outer edge 145 may dimensioned to be smaller than the dimension of the periphery of the cavity 114 of the tray as defined by the sidewall 112. Accordingly, at least a portion of the body of the product disk 140 may be positionable and/or nestable within the cavity 114 of the tray 114. The front portion 140*c* of the product disk 140 may be positioned against and/or adjacent to the front portion 112*a* of the sidewall 112, and the rear portion 140*d* of the product disk 140 may be positioned against and/or adjacent to the rear portion 112*b* of the sidewall 112.

In some examples, the tapered configuration of the sidewall 112 may serve as a physical restriction that prevents the product disk 140 from being disposed further into the cavity 114 of the tray 110. As a result, when the product disk 140 is positioned at least partially within the cavity 114, a space or gap may be formed between the product receiving surface 144 of the product disk 140 and the lower surface 113 of the tray 110 that is sufficiently sized to retain the product 101. Accordingly, the product 101 may be safely disposed within the cavity 114 without being damaged by the sidewall 112 and/or the lower surface 113 of the tray 110. So arranged, the second side 140*b* of the product disk 140 may be positioned adjacent to and/or may extend upwardly from the upper surface 111*b* of the support ledge 111.

As illustrated in FIG. 4, the throughbore 142 allows either a portion of the product 101 to be disposed therethrough and/or alternatively may operate as a window or visual indicator that allows a user to determine the appearance (e.g., the shade, color, and/or other visual characteristic) of the product 101 disposed on the product receiving surface 144 of the product disk 140 when positioned within the cavity 114 of the tray 110.

Figure 15:
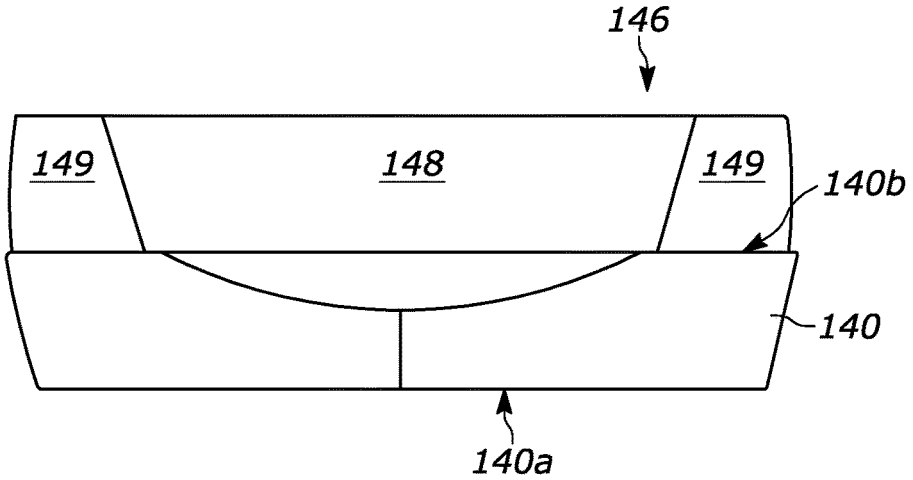
FIG. 15 illustrates a front elevation view of the example product disk of FIGS. 12-14 in accordance with various embodiments.
Figure 16:
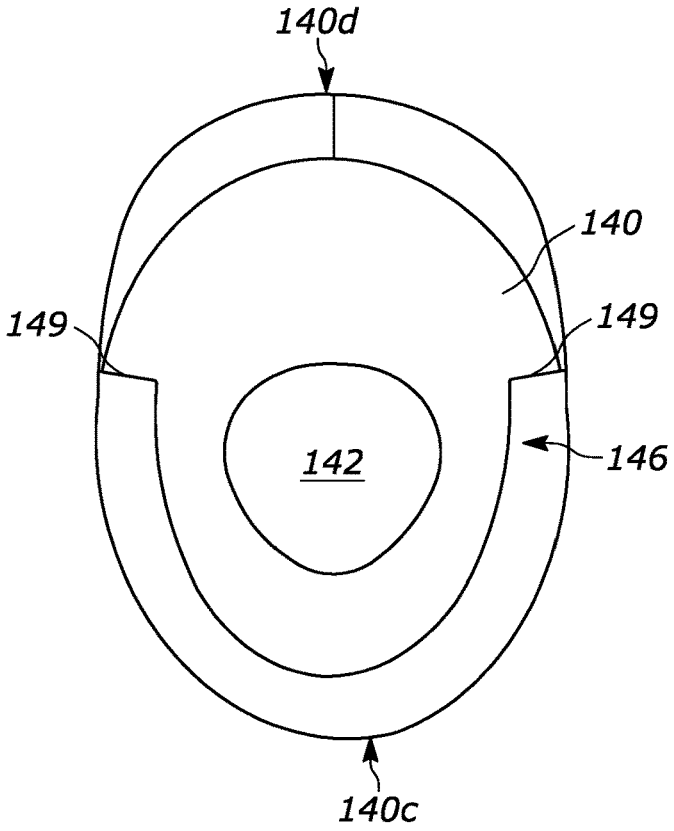
FIG. 16 illustrates a top plan view of the example product disk of FIGS. 12-15 in accordance with various embodiments.
Figure 17:
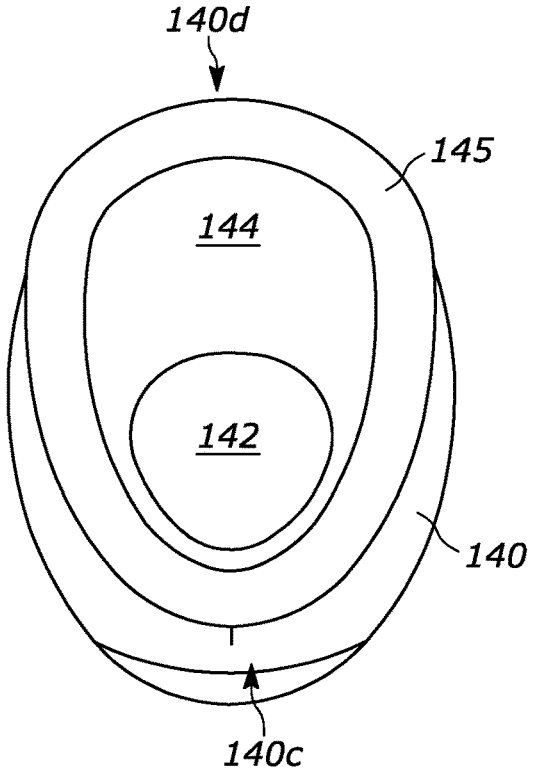
FIG. 17 illustrates a bottom plan view of the example product disk of FIGS. 12-16 in accordance with various embodiments.
Figure 18:
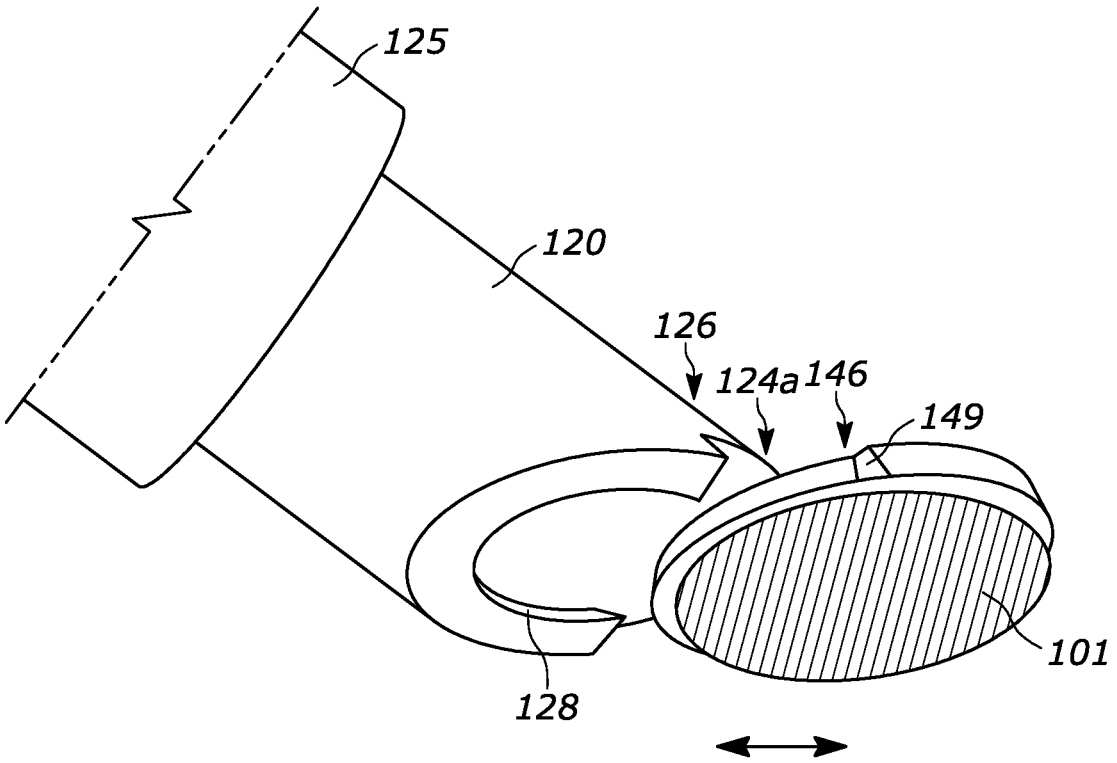
FIG. 18 illustrates a perspective view of the example product disk being coupled with the example applicator tube of the example sampling system of FIGS. 1-17 in accordance with various embodiments.
Figure 19:
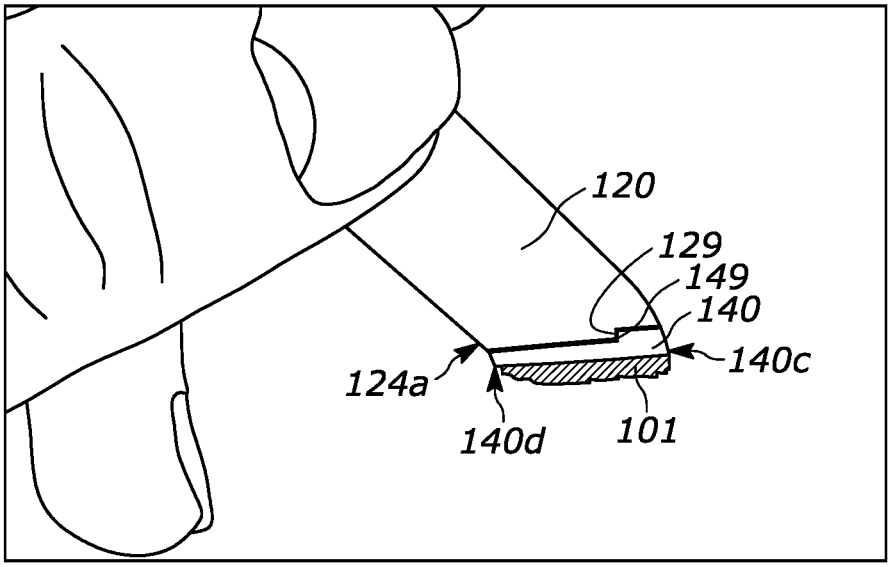
FIG. 19 illustrates a perspective view of an example applicator of the example sampling system of FIGS. 1-18 having an example cosmetic product disk coupled therewith in accordance with various embodiments.

The second side 140*b* of the product disk 140 has a generally planar surface and includes a disk coupling mechanism 146. Generally speaking, the disk coupling mechanism 146 is adapted to selectively engage the applicator coupling mechanism 126 of the applicator tube 124. The disk coupling mechanism 146 is in the form of a raised platform or ledge having a tapered outer sidewall 148 and a stop surface 149. As illustrated in FIGS. 4 and 15, an upper end 146*a* of the disk coupling mechanism 146 has a wider dimension than a lower end 146*b* thereof. Such an arrangement is the opposite of the arrangement of the applicator coupling mechanism 126 of the applicator tube 124. Accordingly, as illustrated in FIGS. 18 and 19, the applicator 120 may slidably engage the product disk 140 by positioning the applicator coupling mechanism 126 near the disk coupling mechanism 146 and sliding the track, towards the raised platform or ledge. The inner surface 128 of the applicator coupling mechanism 126 will be slidably positioned against the outer surface 148 of the disk coupling mechanism 146 such that the product disk 140 is prevented from moving in the axial direction A. Instead, the generally planar surface of the second side 140*b* of the product disk 140 may slide along the generally planar surface of the first end 124*a* of the applicator tube 124.

In operation, any number of product disks 120 may be removably retained within individual cavities 114 of trays 110, which in turn are disposed within respective openings 108*a* of the divider 108, which is disposed within the interior cavity 104*a* of the base 104. Each of these disks may include samples of the product 101 having different visual characteristics (e.g., varying colors or shades, sheen levels (e.g., matte, satin, or sheer), and/or may have varying degrees of transfer resistance). A user may determine which product 101 sample they wish to apply by viewing the product 101 through the throughbore 142 of the product disk 140.

Upon selecting the desired product 101, the user may position the first end 124*a* of the applicator tube 124 near the rear portion 140*d* of the product disk 140, and may move the applicator 120 towards the front portion 140*c* of the product disk 140 in a generally planar direction that is parallel to the upper surface 111*b* of the support ledge. As a result, the applicator coupling mechanism 126 (i.e., the inner sidewall 128) engages the disk coupling mechanism 146 (i.e., the outer sidewall 148). The stop surface 129 of the applicator coupling mechanism 126 may abut the stop surface 149 of the disk coupling mechanism 146 when the applicator tube 124 and the product disk 140 are fully aligned, at which point, continued urging of the applicator tube 124 towards the front portion 140*c* of the product disk 140 may cause the front portion 140*c* of the product disk 140 to contact the front portion 112*a* (and, optionally, any stop mechanism disposed thereon) which may limit or stop movement of the product disk 140 in the lateral direction. A user may then lift the applicator 120 away from the tray 110, which will in turn cause the product disk 140 to be removed therefrom. The user may then apply the sample of the product 101 as desired.

In some examples, when the product disk 140 is fully coupled with the applicator 120, a retention mechanism may be engaged that secures the product disk 140 and the applicator 120. For example, either or both of the stop surfaces 129, 149 may include a magnetic member that urges the product disk 140 towards the applicator 120. In other examples, an alternative or additional securement mechanism such as a detent, a catch, a tab, or other protrusion may be used. In any of these examples, the engagement between the applicator 120 and the product disk 140 may generate a tactile feedback to alert the user that the applicator 120 and the product disk 140 are fully coupled together.

In some examples, the user may place the cap 121 onto the applicator base 122 while the product disk 140 is coupled with the applicator 120.

The product disk 140 may be decoupled from the applicator 120 by positioning the first side 140*a* within the cavity 114 of the tray 110 and moving the applicator 120 away from the product disk 140 in a generally planar direction that is parallel to the upper surface 111*b* of the support ledge 111 (and, in examples where a retention mechanism is provided, with a sufficient force to overcome any retaining forces generated thereby). This movement may cause the rear portion 140*d* of the product disk 140 to contact the rear portion 112*b* of the sidewall 112 of the tray 110, which may act to retain the product disk 140 within the cavity 114 despite continued movement of the applicator 120 away from the cavity 114. In some examples, the rear portion 112*b* may include a magnet that assists with retaining the product disk 140 within the cavity 114.

Upon selectively decoupling the product disk 140 from the applicator 120, a user may couple a different product disk 140 therewith to apply the desired product 101 or may return the applicator to the applicator cavity 116 as desired. So configured, a user may quickly selectively sample any number of varying cosmetic and/or skincare products 101 to determine a desired product for subsequent purchase. In some examples, the applicator tube 124 may include a cavity (not illustrated) dimensioned to accommodate a full-sized quantity of product 101 to allow for the use of the same applicator 120 used to sample varying products 101. In such examples, the applicator tube 124 may include an advance/retract mechanism. In other examples, the applicator tube 124 may be removed from the base 122 when the user determines which full-sized product they wish to purchase, and a replacement applicator (not illustrated) may be inserted into the base 122 that includes a full-sized quantity of product 101. In some examples, the product disks 140 may be reused and/or recycled upon returning them to the manufacturer, thereby potentially reducing overall component and manufacturing costs.

It will be appreciated that any number of modifications may be made to the system 100. For example, each of the applicator coupling mechanism 126 and the disk coupling mechanism 146 may have opposite configurations whereby the applicator is inserted into a portion of the product disk. Other arrangements are possible.

In the foregoing specification, specific examples have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described examples/implementations should not be interpreted as mutually exclusive, and should instead be understood as potentially combinable if such combinations are permissive in any way. In other words, any feature disclosed in any of the aforementioned examples/implementations may be included in any of the other aforementioned examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A reusable product system comprising:

an applicator having a first end including an angled surface and an applicator coupling mechanism, the applicator coupling mechanism including an elevated track extending about a periphery of the angled surface; and a product disk having a first side, a second side, and a body extending therebetween defining a ledge, the second side of the product disk being positionable adjacent to the first end of the applicator; and a cosmetic product being at least partially disposed on the first side of the product disk;

wherein the product disk is adapted to removably couple with the applicator via sliding engagement between the ledge and the applicator coupling mechanism.

2. The reusable product system of claim 1, wherein the angled surface extends obliquely from a longitudinal axis defined by the applicator.

3. The reusable product system of claim 1, further comprising a visual indicator defined by the body of the product disk, the visual indicator adapted to allow identification of the cosmetic product when the product disk is not coupled with the applicator.

4. The reusable product system of claim 1, wherein the applicator further includes an interior cavity adapted to receive additional cosmetic product disposed on the second side of the product disk.

5. The reusable product system of claim 1, wherein the cosmetic product includes at least one of a lipstick, a foundation, a concealer, an eyeshadow, a bronzer, a brow, a solid serum, a solid SPF product, a skin care item, a solid face balm, a lip balm, an applicator head, a brush, a solid blush, a solid contouring stick, an impregnated sponge or carrier, or a semi-solid skin care or cosmetic product.

* * * * *